US006395442B1

(12) United States Patent
Hayashi et al.

(10) Patent No.: US 6,395,442 B1
(45) Date of Patent: May 28, 2002

(54) TONER AND PRODUCTION METHOD OF THE SAME

(75) Inventors: Kenji Hayashi; Mikio Koyama, both of Hino; Masafumi Uchida, Hachioji; Hiroshi Yamazaki, Hachioji; Tsuyoshi Uchida, Hachioji, all of (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/625,618

(22) Filed: Jul. 24, 2000

(30) Foreign Application Priority Data

Jul. 30, 1999 (JP) ..... 11-216628
Jul. 30, 1999 (JP) ..... 11-216631
Jul. 30, 1999 (JP) ..... 11-216632

(51) Int. Cl.[7] ..... G03G 9/087
(52) U.S. Cl. ..... 430/109.4; 430/109.5; 430/137.16
(58) Field of Search ..... 430/106, 109, 430/110, 137, 109.4, 109.5, 137.16

(56) References Cited

U.S. PATENT DOCUMENTS 5,057,392 A * 10/1991 McCabe et al. ..... 430/109
5,866,290 A * 2/1999 Sacripante et al. ..... 430/110
5,888,687 A * 3/1999 Matsumura et al. ..... 430/137

FOREIGN PATENT DOCUMENTS

JP 6327856 2/1988
JP 6357855 3/1988

* cited by examiner

*Primary Examiner*—John Goodrow
(74) *Attorney, Agent, or Firm*—Bierman, Muserlian and Lucas

(57) ABSTRACT

A toner for electrophotography is disclosed. The resin binder is obtained by fusing fine resin particles comprising a crystalline material and amorphous polymer in a water-based medium. The crystalline material preferably has a melting point of 60 to 130° C., a number average molecular weight of 1,500 to 15,000, and a melt viscosity at the melting point +20° C. of not more than 100 Pa·s, and the amorphous polymer is preferably composed of a radically polymerizable monomer.

20 Claims, 2 Drawing Sheets

TONER AND PRODUCTION METHOD OF THE SAME

FIELD OF THE INVENTION

The present invention relates to a toner and a production method of the same.

BACKGROUND OF THE INVENTION

With response to energy saving in recent years, enhancement of fixability of toners has been investigated. In order to enhance the fixability of the toner, it is preferred that the melt viscosity of a resin component, which composes said toner, is lowered. However, when the melting temperature of said resin component is excessively low, the storage stability of said toner tends to be degraded. Accordingly, development of toner has been demanded in which fixability and storage stability are both within acceptable ranges.

As techniques to enhance the fixability of toner, it is known that microdomains are formed employing substances such as crystalline polyesters and the like together with amorphous polymers. Japanese Patent Publication Open to Public Inspection Nos. 63-57855 and 63-27856 disclose toner in which polymers, which are prepared through chemical graft- or block-polymerization of amorphous vinyl polymer with crystalline polyester, are employed as the resin component. However, though such a technique is employed, it is difficult to decrease melt viscosity by employing the crystalline polyester, and the enhancement of fixability is limited.

In order to enhance the fixability of toner, it is necessary that crystalline materials uniformly exist at a definite ratio in toner particles while maintaining a domain structure at a certain level. However, a method has not yet been discovered which allows crystalline materials to exist in toner particles in such a state (domain structure). For example, even though incorporation of crystalline materials into toner particles is attempted by employing a mix-kneading method, said crystalline material melts due to the heat produced during mix kneading. As a result, it is impossible to form the domain structure, and it is currently impossible to enhance the fixability by incorporation of crystalline materials into toners.

SUMMARY OF THE INVENTION

It is an object of the present invention to provide a toner which has a wide fixable temperature range as well as excellent fixability, and a production method of the same.

The other object is to obtain a toner having sharp charging distribution, and excellent in image quality and resolving power.

The toner of the present invention is obtained by fusing or coalescing fine resin particles comprising amorphous polymers and crystalline materials in a water-based medium.

Further, said crystalline materials preferably have a melting point of 60 to 130° C., a number average molecular weight of 1,500 to 15,000, and a melt viscosity at the melting point +20° C. of not more than 100 dpa·s.

Toner of the present invention is obtained in such a manner that fine resin particles are obtained by emulsion polymerizing a radical-polymerizable monomer solution prepared by dissolving crystalline materials, and the resulting fine resin particles are fused or coalesced in a water-based medium.

Further, said crystalline materials preferably have a melting point of 60 to 130° C., a number average molecular weight of 1,500 to 15,000, and a melt viscosity at the melting point +20° C. of not more than 100 dPa·s.

The inventors of the present invention have conducted investigations regarding the realization of fixability enhancement effects in a toner by employing crystalline materials. As a result, it was discovered that a toner obtained by incorporating crystalline materials into said toner employing a specified production method fully exhibits said effects.

In the present invention, crystalline material is previously incorporated into fine resin particles and the resulting fine resin particles are then fused or coalesced. As a result, it is possible that the presence of said crystalline material is varied to a certain domain structure.

The production method of the present invention is one in which a toner is formed by fusing fine resin particles comprised of amorphous polymers, for example vinyl polymers, and crystalline materials. By employing said method, it is possible to subject fine resin particles themselves to function as a so-called microdomain structure, and thus it is possible to enhance the fixability of the obtained toner.

In order to incorporate crystalline materials into fine resin particles, first, a uniform solution is prepared by dissolving crystalline materials in radical-polymerizable monomers composing amorphous vinyl polymers. Subsequently, the resulting solution is emulsify dispersed into a water-based medium, and polymerization is carried out in the system to form fine resin particles. As a result, as the polymerization proceeds, crystalline materials are deposited in the interior of the fine resin particle, and thereby the desired domain can be formed. By utilizing this method, it is possible to form a uniform domain structure. Further it is possible to control the diameter of the fine resin particles so as to form a relatively uniform particle diameter distribution. Thus, it is possible to uniformly disperse the crystalline materials into the toner. Further, during the incorporation of crystalline materials into the toner, excessive heat energy is not provided. As a result, crystalline materials do not melt. Thus the domain neither increases nor decreases, and even in the worst case, neither is the domain dissolved in the resin, nor does it disappear.

The toner of the invention has narrow and sharp toner size distribution and uniform toner shape. Accordingly the toner has narrow and sharp charge distribution, which gives image with high quality, high resolution and good gradation.

DETAILED DESCRIPTION OF THE INVENTION

<Production Method of Toner>

Figure 1:
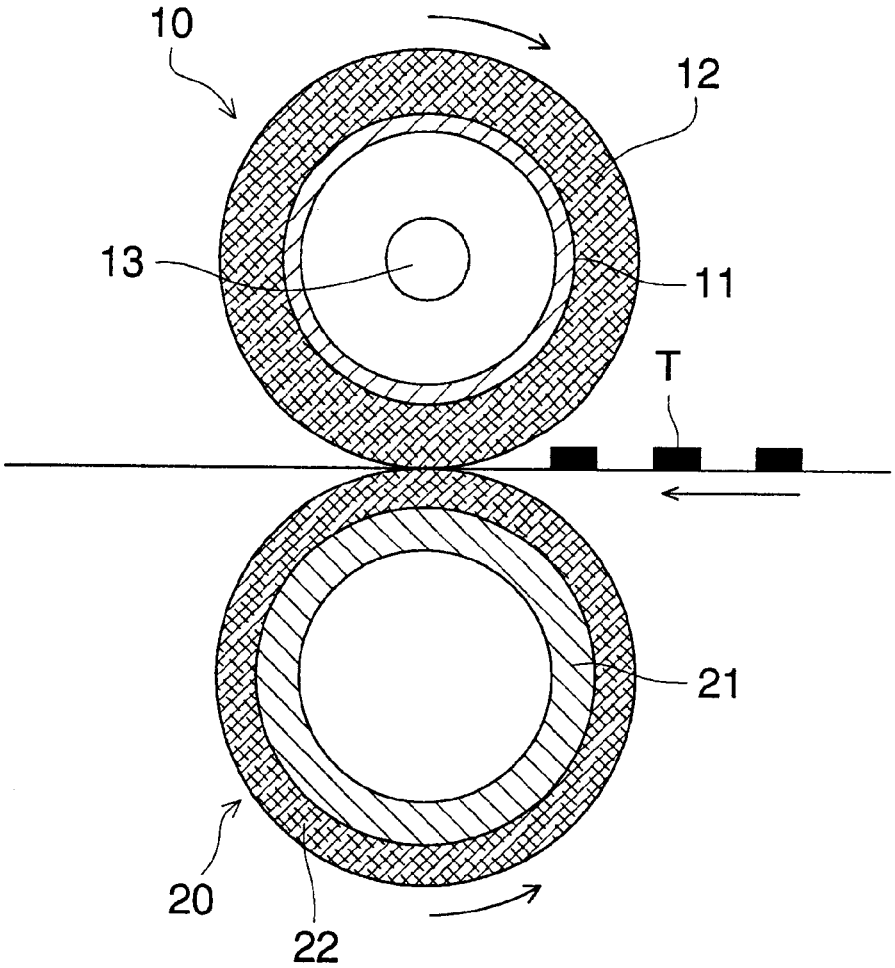
FIG. 1 is a cross-sectional view showing an example of a fixing unit employing a heating roll fixing system.

It is possible that the toner of the present invention is produced by fusing fine resin particles in a water-based medium.

Listed as methods for fusing fine resin particles in a water-based medium may be those described in, for example, Japanese Patent Publication Open to Public Inspection Nos. 63-186253, 63-282749, 7-146583, and others. Listed as the most preferable fusing method is one in which fine resin particles are subjected to salting-out/fusing in a water-based medium.

The "salting-out/fusing", as described in the present invention, means the simultaneous occurrence of salting-out (coagulation of fine particles) and fusing (elimination of the boundary surface among the fine particles), or the simultaneous occurrence of salting-out and fusing. In order to simultaneously carry out salting-out and fusing, it is necessary to coagulate fine particles (fine resin particles or fine colorant particles) at no lower than the glass transition temperature (Tg) of resins composing said fine resin particles.

The weight average particle diameter of fine resin particles, which are employed to obtain the toner of the present invention, is preferably between 50 and 2,000 nm, and particularly preferably 50 to 300 nm. Such fine resin particles may be obtained employing any of the several granulation polymerization methods such as an emulsion polymerization method, a suspension polymerization method, a seed polymerization method, and the like. However, preferred are fine resin particles which are obtained employing the emulsion polymerization method.

<Crystalline Materials>

The crystalline materials incorporated into fine resin particles are those which provide excellent fixability (adhesion to an image support) with the toner which is obtained by fusing said fine resin particles.

(Physical Properties of Crystalline Materials)

The melting point of crystalline materials described above is preferably between 60 and 130° C., and is more preferably between 60 and 120° C.

When crystalline materials, having a melting point in the range of 60 to 130° C., are employed, it is possible to lower the entire melt viscosity of the obtained toner, and it is also possible to attempt the enhancement of adhesion to paper and the like. In addition, even though said crystalline materials are present, the elastic modulus on the high temperature side is maintained in the preferred range. Thus excellent offset resistant properties are exhibited. When the melting point of crystalline materials is less than 60° C., fixability is improved. However, commercially unviable problems occur due to the degradation of storage stability. On the other hand, when the melting point exceeds 130° C., contribution to the enhancement of fixability decreases due to an increase in the melt initiation temperature. Thus reduced effect for the improvement of fixability is exhibited.

The melting point of crystalline materials, as described herein, means the value measured by a differential scanning calorimeter (DSC). Specifically, when temperature increases at a rate of 10° C./minute from 0 to 200° C., the temperature, which shows the maximum peak of measured endothermic peaks, is designated as the melting point. Cited as a specific measurement apparatus may be DSC-7 manufactured by Perkin-Elmer Corp.

(Physical Properties of Crystalline Materials)

Crystalline materials composing the toner in accordance with the present invention generally exhibits an endothermic peak (P1) in the range of 50 to 130° C. during the first temperature rising stage, as measured with a DSC, and preferably exhibits the same in the range of 50 to 130° C., and more preferably exhibits the same in the range of 60 to 120° C.

Further, said crystalline materials exhibit an exothermic peak (P2) in the range of 30 to 110° C. during the first cooling process, employing a DSC, and preferably exhibit the same in the range of 40 and 100° C.

Herein, the relationship of P1≧P2 is held between the endothermic peak (P1) and the exothermic peak (P2). The temperature difference (P1–P2) is not particularly limited, but is preferably not more than 50° C.

By incorporating the crystalline materials having thermal properties as described above as the resinous component into toner, as can clearly be seen from the results of examples described below, it is possible to exhibit excellent offset resistant effects (a wider fixable temperature range) as well as excellent fixability (high fixing ratio).

It is preferable that the amorphous polymers and the crystalline materials preferably exist in a state independent of each other. Namely, said crystalline materials abruptly melt and the resulting molten state exhibits an action to dissolve the amorphous polymers. As a result, it is possible to decrease the entire melt viscosity of the toner, and thus it is possible to enhance the fixability. Further, by allowing both to be present independent of each other, it becomes possible to minimize the decrease in the elastic modulus. As result, the offset resistance is not degraded.

When the endothermic peak (P1) is less than 50° C., fixability is enhanced due to the low melting temperature, while offset resistant properties as well as storage stability are degraded.

Further, when the endothermic peak (P1) exceeds 130° C., a compatibility temperature with the amorphous polymer increases due to the high melting temperature. As a result, it is impossible to realize the enhancement of the fixability.

When an exothermic peak (P2), showing a recrystallization state, is present in the range of less than 30° C., it is impossible to carry our recrystallization without cooling to a fairly low temperature. Such a substance is to be present in the toner in the low crystallizing state, which is not capable of contributing to the enhancement of fixability.

Further, when an exothermic peak (P2) exists in the range exceeding 110° C., the recrystallization temperature is excessively high. As a result, the so-called fusing temperature becomes higher, and the low temperature fixability is degraded.

The endothermic peak (P1), as well as the exothermic peak (P2), is measured employing a differential scanning colorimeter (DSC). Heating and cooling conditions are as follows. After resting at 0° C. for one minute, temperature is increased at a rate of 10° C./minute up to 200° C., and a maximum endothermic peak measured during the increase in temperature is designated as P1. Then after resting at 200° C. for one minute, the temperature is decreased at a rate of 10° C./minute, and the temperature which shows the maximum exothermic peak, measured during the decrease in temperature, is designated as P2. Cited as a specific apparatus may be DSC-7 manufactured by Perkin Elmer Corp.

The number average molecular weight of crystalline materials is preferably between 1,500 and 15,000, and is more preferably between 2,000 and 10,000. In the toner obtained employing crystalline materials having a number average molecular weight of 1,500 to 15,000, compatibility with amorphous polymers which are employed to realize a total decrease in the melt viscosity is improved in a molten state, and thus the fixability in the lower temperature range is enhanced. When said number average molecular weight is less than 1,500, the melt viscosity of said crystalline materials becomes excessively low, and on the contrary, the compatibility state tends to be non-uniform. As a result, it becomes difficult to enhance the desired fixability. On the other hand, when the number average molecular weight exceeds 15,000, it takes extra time to melt the crystalline materials, and the compatibility state also becomes non-uniform. Thus, effects to enhance the fixability are insufficient.

Condition

Model of machine employed: LC-6 A (manufactured by Shimadzu Corp.)

Column: Ultrastyragel Plus

Analysis temperature: 60° C.

Solvent: m-cresol/chlorobenzene 3/1 (volume ratio)

Calibration curve: Standard polystyrene calibration curve

It is preferable that melt viscosity of a crystalline material (viscosity at melting point +20 degrees) is less than 100 dPa·s and more preferably less than 60 dpa·s.

When a crystalline material having melt viscosity of less than 100 dPa·s is employed, melt viscosity as a whole including the amorphous polymer can be lowered, and fixing ability improves in provided-toner.

Improvement effect of fixing ability deteriorates because total melt viscosity becomes high when the melt viscosity exceeds 100 dPa·s.

Melt viscosity of a crystalline material (viscosity by melting point +20 degrees) means a value measured by a cone plate viscometer.

Peak molecular weight of the crystalline material measured by GPC is with 6,000–50,000.

The compound which constitutes a crystalline material As a compound constituting a crystalline material polyester, polyamide, polyimide can be given, and polyester obtained by reaction of aliphatic diol with an aliphatic dicarboxylic acid (acid anhydride and acid chloride are included), and polyamide obtained by reaction of aliphatic diamine and aliphatic dicarboxylic acid (acid anhydride and acid chloride are included) are preferable.

Example of the diol which is used in order to obtain crystalline polyester includes ethylenglycol, diethylene glycol, triethylene glycol, 1,2-propylene glycol, 1,3-propylene glycol, 1,4-butane diol, 1,4-butene diol, neopentyl glycol, 1,5-pentane glycol, 1,6-hexane glycol, 1,4-cyclohexane diol, 1,4-cyclohexane di methanol, dipropylene glycol, polyethylene glycol, polypropylene glycol, poly tetramethylene glycol, bisphenol A, bisphenol Z, and hydrogenated bisphenol A.

Example of the diamine which is used in order to obtain crystalline polyamide includes ethylenediamine, diethylene diamine, triethylenediamine, 1,2-propylenediamine, 1,3-propylenediamine, 1,4-butanediamine, 1,4-butene diamine, 2,2-dimethyl-1,3-butane diamine, 1,5-pentane diamine, 1,6-hexanediamine, 1,4-cyclohexane diamine, 1,4-cyclohexane and dimethylamine.

As the dicarboxylic acid which is use in order to obtain crystalline polyester and crystalline polyamide, oxalic acid, malonic acid, succinic acid, glutaric acid, adipic acid, pimelic acid, suberic acid, azelaic acid, sebacic acid, maleic acid, fumaric acid, citraconic acid, itaconic acid, .glutaconate, n-dodecyl succinic acid, n-dodecenyl succinic acid, iso dodecyl succinic acid, iso dodecenyl succinic acid, n-octyl succinic acid, n-oxotenyl succinic acid, and these acid anhydride or an acid chloride can be mentioned.

In particular as a preferable crystalline material, polyester obtained by reacting cyclohexane diol or 1,4-cyclohexanedimethanol with adipic acid, polyester obtained by reacting 1,6-hexanediol or 1,4-cyclohexane dimethanol with sebacic acid, polyester obtained by reacting ethylenglycol and succinic acid, polyester obtained by reacting ethylenglycol and sebacic acid, polyester obtained by reacting 1,4-butanediol and succinic acid can be mentioned. Among these, the polyester obtained by reacting cyclohexane diol, 1,4-cyclohexanedimethanol and adipic acid is particularly preferable.

<Amorphous Polymer>

Physical Property of Amorphous Polymer

It is preferable that the glass transition temperature (Tg) of the amorphous polymer (for, example amorphous vinyl polymer) contained in a resin fine particle is preferable 10–75° C., and more preferably 40–65° C. And, as for the softening point of an amorphous polymer, it is preferable to be 80–220° C.

It is preferable that the amorphous polymer has weight average molecular weight (Mw) of 5,000–1,000,000 and more preferably 8,000–500,000, and it is preferable that number average molecular weight (Mn) is 2,000–200,000. It is preferable that molecular weight distribution (Mw/Mn) is 2.0–100 and more preferably 5.0–80.

The softening point of the amorphous polymer denotes a value measured by employing capillary type flow tester (manufactured by Shimadzu Corp.). To be concrete, the softening point is temperature corresponding to ½ height from flow starting point to flow end point when 1 g of the sample is flow through a die having pore of diameter 1 mm and 1 mm long, at a condition of load 20 kg/cm$^2$ with raising temperature speed of 6° C./min employing capillary type flow tester CFT-500 (manufactured by Shimadzu Corp.).

Glass transition point of an amorphous polymer is intersection of a baseline and gradient of endotherm peak, and is measured by DSC. To be concrete, employing differential scanning calorimetry, sample is heated to 100° C., and it is kept for 3 minutes at the same temperature, then cooled off to room temperature with descent temperature 10° C./min. Next the sample is heated with rising speed at 10° C./min. At this measurement the intersection of a baseline and maximum gradient from the rising portion to the peak is the glass transition point.

As measuring apparatus, DSC-7 manufactured by Perkin-Elmer company can be used.

Molecular weight of an amorphous polymer is shown as styrene converted molecular weight measured by GPC. The molecular weight of the resin is measured by GPC (gel permeation chromatography) employing tetrahydrofuran (THF) as solvent. To the sample of 0.5–5 mg, particularly 1 mg, 1 ml of THF is added and the mixture is stirred using magnetic stirrer at room temperature to dissolve. It is injected to GPC after having processed with membrane filter having pore size of 0.45–0.50 $\mu$m.

The measurement of GPC is conducted in such a way that the column is stabilized at 40° C., and THF is carried away with flow velocity of 1 ml/min, and about 100 $\mu$l of sample having density of 1 mg/ml is injected. It is preferable to employ plural polystyrene gel columns available in the market in combination. For example a combination of Shodex GPC KF-801, 802,803,804,805,806 and 807 each of which is manufactured by Showa Denko K.K., a combination of TSK gel G1000H, G2000H, G3000H, G4000H, G5000H, G6000H, G7000H and TSK guardcolumn, each of which is manufactured by TOSOH CORP. can be given. And a refractive index detector (IR detector) or a UV detector is employed as a detector.

In measuring molecular weight of a sample, the molecular weight distribution of the sample is calculated employing calibration curve prepared by using monodispersed polystyrene standard particle. It is preferable to employ around 10 points as polystyrene for preparation of calibration curve.

Polymer Constitutes Amorphous Polymer

As polymerizable monomer to use in order to get an amorphous polymer, radically polymerizable monomer is used as a component, and crosslinking agent can be used at need. And it is preferable to contain at least one kind of radically polymerizable monomer having an acidic group such as carboxylic group and sulfonic or a radically polymerizable monomer having basic group such as amino group mentioned below.

(1) Radically Polymerizable Monomer

As radically polymerizable monomer component, radically polymerizable monomer can be employed without particular restriction. And those of one kind or two kinds or more are employed in combination to meet demanded characteristics. To be concrete, aromatic system vinyl monomer, (meta) acrylate series monomer, vinylester series monomer, vinyl ether series monomer, monoolefin series monomer, diolefin series monomer, halogenation olefin series monomer etc. can be employed. As aromatic system vinyl monomer, for example, styrene series monomer such as styrene, o-methylstyrene, m-methylstyrene, p-methylstyrene, p-methoxystyrene, p-phenyl styrene, p-chlorostyrene, p-ethyl styrene, p-n-butylstyrene, p-tert-butylstyrene, p-n-hexyl styrene, p-n-octyl styrene, p-n-nonyl styrene, p-n-decyl styrene, p-n-dodecyl styrene, 2,4-dimethyl styrene, 3,4-dichloro styrene and their derivatives are mentioned.

As (meta)acrylate series monomer, methyl acrylate, ethyl acrylate, butyl acrylate, 2-ethylhexyl acrylate, cyclohexyl acrylate, phenylacrylate, methyl methacrylate, ethyl methacrylate, butyl methacrylate, hexyl methacrylate, methacrylic acid-2-ethylhexyl, β-hydroxy ethyl acrylate, γ-amino propyl acrylate, methacrylic acid stearyl, dimethylaminoethyl methacrylate, methacrylic acid diethylaminoethyl are exemplified.

As (metha)acrylate series monomer, methyl acrylate, ethyl acrylate, butyl acrylate, 2-ethylhexyl acrylate, cyclohexyl acrylate, phenylacrylate, methyl methacrylate, ethyl methacrylate, butyl methacrylate, hexyl methacrylate, 2-ethylhexyl methacrylate, β-hydroxy ethyl acrylate, γ-amino propyl acrylate, methacrylic acid stearyl, dimethylaminoethyl methacrylate, methacrylic acid diethylaminoethyl are exemplified.

Vinyl acetate, vinyl propionate and vinyl benzoic acid are exemplified for vinylester series monomer. As vinyl ether series monomer, vinylmethylether, vinyl ethyl ether, vinyl isobutyl ether and vinylphenyl ether are exemplified.

As monoolefin series monomer, ethylene, propylene, isobutylene, 1-butene, 1-pentene and 4-methyl-l-pentene are exemplified.

Butadiene, isoprene and chloroprene are exemplified for diolefin series monomer. Chloroethylene, vinylidene chloride and vinyl bromide are exemplified for halogenated olefin series monomer.

(2) Crosslinking Agent

A crosslinking agent such as radically polymerizable crosslinking agent may be added in order to improve characteristics of toner.

As the radically polymerizable crosslinking agent, those having two or more unsaturated bond such as divinylbenzene, divinyl naphthalene, divinyl ether, diethyleneglycol methacrylate, ethylenglycol dimethacrylate, polyethyleneglycol dimethacrylate and diallyl phthalate is exemplified.

(3) Radically Polymerizable Monomer Having Acidic Group and Radically Polymerizable Monomer Having Basic Group Examples of the radically polymerizable monomer having acidic group and the radically polymerizable monomer having basic group include a carboxyl group containing monomer, a sulfonic acid group containing monomer and an amine compound such as primary amine, secondary amine, tertiary amine, a quaternary ammonium salt.

As the radically polymerizable monomer having acidic group, carboxylic group containing monomer such as acrylic acid, methacrylic acid, fumaric acid, maleic acid, itaconic acid, cinnamic acid, maleic acid monobutyl ester, maleic acid mono octyl ester are mentioned.

Styrenesulfonic acid, allylsulfo succinic acid, allyl sulfo succinic acid octyl are mentioned for sulfonic acid group containing monomer.

These may have a structure of alkali metal salt such as sodium or potassium salt, or alkaline earth metal salt such as calcium salt.

As for radically polymerizable monomer having basic group compound, amine series is nominated, whose examples are dimethylaminoethyl acrylate, dimethylaminoethyl methacrylate, diethylaminoethyl acrylate, diethylaminoethyl methacrylate and quaternary ammonium salt of the 4 compounds mentioned above, 3-dimethylaminophenyl acrylate, 2-hydroxy-3-methacryloxy propyl trimethylammonium salt, acrylamide, N-butylacrylamide, N,N-dibutyl acrylamide, piperidyl acrylamide, methacryl amide, N-butyl methacryl amide, N-octadecyl acrylamide; vinylpyridine, vinylpyrrolidone; and vinyl N-methylpyridinium chloride, vinyl N-ethyl pyridinium chloride, N,N-diallyl methylammonium chloride, and N,N-diallyl ethylammonium chloride.

It is preferable to use 0.1–15 weight % of the radically polymerizable monomer having acidic group or the radically polymerizable monomer having basic group as radically polymerizable monomer employed in the present invention with respect to whole monomers, and radically polymerizable crosslinking agent is employed, depending on its characteristics, in an amount of 0.1–10 weight % of whole radically polymerizable monomer.

[Chain Transfer Agent]

Chain transfer agent may be employed to adjust molecular weight of the amorphous polymer. As the chain transfer agent, octyl mercaptan, dodecyl mercaptan, mercaptan of tert-dodecyl mercaptan, styrene diner etc. are employed without particular restriction.

[Polymerization Initiator]

A radical polymerization initiator can be employed appropriate as far as it is water soluble in the present invention. Example of the initiator includes persulfate such as potassium persulfate and ammonium persulfate; azo compound such as 4,4'-azobis-4-cyano valeric acid and its salt, 2,2'-azobis(2-amidino propane) salt; and peroxide compounds. The above radical polymerization initiator can be employed as redox initiator compounds in combination with reducing agent if necessary. It is expected by employing the redox initiator compounds that polymerization activity rises, polymerization temperature can be lowered and polymerization time can be shortened. Polymerization temperature may be optionally selected if it is more than the minimum radical generation temperature of polymerization initiator, and, for example, 50 to 90° C. is employed. Polymerization can be done at room temperature or more by employing a polymerization initiator working at normal temperature such as combination of hydrogen peroxide-reducing agent (ascorbic acid, etc.).

[Surface Active Agent]

Surface active agent is employed for emulsion polymerization in case the above-mentioned radically polymerizable monomer is used.

Surface active agents can be employed for the purpose without particular restriction. Ionic surfactants listed below can be suitably employed.

As ionic surfactant, sulfonate such as dodecyl benzene sulfonic acid sodium, arylalkyl polyethersulfone acid sodium, 3,3-disulphone diphenylurea-4,4-diazo-bis-amino-8-naphthol-6-sodium sulphonate, ortho-carboxy benzene-azo-dimethylaniline) and 2,2,5,5-tetramethyl-triphenyl methane-4,4-diazo-bis-β-naphthol-6-sodium sulphonate; sulfuric ester salt such as sodium dodecyl sulfate, sodium-tetradecyl sulfate, pentadecyl sodium sulfate and sodium octylsulphate; fatty acid salt such as sodium oleate, lauric acid sodium, capric acid sodium, caprylic acid sodium, caproic acid sodium, stearic acid potassium and oleic acid calcium are given.

A nonionic surface active agent can also be used. To be concrete polyethylene oxide, polypropylene oxide, combination of polypropylene oxide and polyethylene oxide, ester of polyethyleneglycol and higher fatty acid, alkylphenol polyethylene oxide, ester of higher fatty acid and a polyethyleneglycol, ester of higher fatty acid and polypropylene oxide, and sorbitan ester can be exemplified.

These are used for emulsifying agent in emulsion polymerization mainly in the present invention. They may be used in other process or for other purpose of use. Ratio of Crystalline Material to Amorphous Polymer As a containing ratio of a crystalline material to an amorphous polymer forming resin fine particles, it is preferable that a crystalline material is 1–200 weight parts, and more preferably 2–100 weight part, and in particular 3–50 weight parts with reference to 100 weight parts of the amorphous polymer.

When the content of the crystalline material is too little, toner having enough fixing. ability is not provided. On the other hand when crystalline material is surplus there is a problem that an offset is easy to come to occur because the crystalline material melts in excess, and melt viscosity is lowered.

<Coloring Agent>

Inorganic pigment and organic pigment can be employed for coloring agent to constitute toner of the present invention.

Arbitrary inorganic pigment can be employed.

Practical inorganic pigment is listed below.

Carbon black such as furnace black, channel black, acetylene black, thermal black and lamp black is exemplified as black pigment. Magnetic powders such as magnetite and ferrite are employed for black pigment.

These inorganic pigment can be used individually or two or more in combination selected according to needs. And the content of pigment is usually 2–20 weight %, and preferably, 3–15 weight % of polymer. The above-mentioned magnetite can be employed to use as magnetic toner. It is preferable to employ 20–60 weight % of magnetite in toner from a point of view to give predetermined magnetic characteristics in this case.

An organic pigment can be also employed.

Practical organic pigment is exemplified below.

Magenta or Red Pigment

C.I. Pigment red 2, C.I. Pigment red 3, C.I. Pigment red 5, C.I. Pigment red 6, C.I. Pigment red 7, C.I. Pigment red 15, C.I. Pigment red 16, C.I. Pigment red 48:1, C.I. Pigment red 53:1, C.I. Pigment red 57:1, C.I. Pigment red 122, C.I. Pigment red 123, C.I. Pigment red 139, C.I. Pigment red 144, C.I. Pigment red 149, C.I. Pigment red 166, C.I. Pigment red 177, C.I. Pigment red 178, and C.I. pigment red 222.

Orange or Yellow Pigment

C.I. Pigment orange 31, C.I. Pigment orange 43, C.I. Pigment yellow 12, C.I. Pigment yellow 13, C.I. Pigment yellow 14, C.I. Pigment yellow 15, C.I. Pigment yellow 17, C.I. Pigment yellow 93, C.I. Pigment yellow 94, C.I and Pigment yellow 138.

Green or Cyan Pigment

C.I. Pigment blue 15, 0.I. Pigment blue 15:2, C.I. Pigment blue 15:3, C.I. Pigment blue 16, C.I. Pigment blue 60 and C.I. pigment green 7.

These organic pigments can be used individually or two or more jointly selected according to needs.

And content of pigment is usually 2–20 weight % and preferably 3–15 weight % for polymer.

<Outer Additive>

So-called outer additive is added to toner of the present invention for a purpose of improvement of fluidity, charging characteristics and cleaning characteristics. Various kinds of inorganic fine particles, organic fine particles and lubricant can be employed. Various inorganic fine particles can be used. Fine particles of silica, titanium, alumina etc. can be preferably employed practically. Hydrophobic inorganic fine particles are preferable.

As fine particles of silica R-805, R-976, R-974, R-972, R-812 and R-809 manufactured by Nihon Aerosil Co., Ltd., HVK-2150 and H-200 manufactured by Hoechst company, TS-720, TS-530, TS-610, H-5 and MS-5 manufactured by Cabot company, are mentioned as practical example.

As titanium fine particle, T-805 and T-604 manufactured by Nihon Aerosil Co., Ltd., MT-100S, MT-100B, MT-500BS, MT-600, MT-600SS and JA-1 manufactured by TAYCA Coprporation, TA-300, SI TA-500, TAF-130, TAF-510 and TAF-510T manufactured by Fuji titanium company, IT-S, IT-OA, IT-OB and IT-OC manufactured by Idemitsu Kosan company, are mentioned for example.

As alumina fine particle, RFY-C and C-604 manufactured by Nihon Aerosil Co., Ltd., TTO-55 of manufactured by ISHIHARA SANGYO KAISHA, LTD. are given for example.

Spherical organic fine particles having number average primary particle diameter around 10–2000 nmcan be employed. Homopolymer such as styrene or methyl methacrylate and copolymer of these can be used.

As lubricant, for example, stearic acid salt of such as zinc, aluminum, copper, magnesium and calcium, salt of oleic acid of such as zinc, manganese, iron, copper and magnesium, palmitic acid salt of such as zinc, copper, magnesium and calcium, linoleic acid salt of such as zinc and calcium, ricinoleic acid salt of such as zinc and calcium, and metal salt of higher fatty acid are given.

Content of these outer additive is preferably around 0.1–5 weight % for toner.

<Toner Production Processes>

One example of the production method of the present invention comprises:

(1) a dissolution process to dissolve crystalline materials in radical-polymerizable monomers,
(2) a polymerization process to prepare a fine resin particle dispersion,
(3) a fusion process to obtain toner particles (coalesced particles) by fusing fine resin particles in a water-based medium,
(4) a filtration washing process to remove surface active agents and the like from said toner particles by separating said toner particles from the toner particle dispersion while filtering,
(5) a drying process to dry said toner particles which have been cleaned with washing, and
(6) a process may be included in which external additives are added to said toner particles which have been subjected to said drying process.

Each process will now be described below.

(Dissolution Process)

This process is one to dissolve crystalline materials in radical polymerizable monomers to prepare a radical polymerizable monomer solution comprising crystalline materials.

The employed ratio of said crystalline materials is preferably between 1 and 200 weight parts with respect to 100 weight parts of said radical polymerizable monomers, however the ratio is more preferably between 2 and 100 weight parts, and is most preferably between 3 and 50 weight parts.

(Polymerization Process)

In an appropriate example of said polymerization process, droplets of said radical polymerizable monomer solution, comprising crystalline materials, are formed in a water-based medium (being an aqueous solution comprising surface active agents and radical polymerization initiators), and polymerization is carried out in said droplets employing radicals generated from said radical polymerization initiators. Further, oil-soluble polymerization initiators may be incorporated into said droplets. In such a polymerization process, a process (liquid droplet formation), in which emulsification is forcibly carried out under application of mechanical energy, is essential. Cited as such mechanical energy applying means may be those such as homomixers, ultrasonic homogenizers, Manton-Gaulin homogenizers, and the like which provide vigorous agitation or ultrasonic vibration energy.

By the use of said polymerization process, obtained are fine resin particles comprising said crystalline materials as well as amorphous polymers. Such fine resin particles may be either colored or non-colored. The fine colored resin particles are obtained by polymerizing monomer compositions comprising colorants.

Further, when fine non-colored resin particles are employed, it is possible to prepare toner particles in such a manner that in the fusion process described below, a fine colorant particle dispersion is added to a fine resin particle dispersion, and fine resin particles are fused with fine colorant particles.

(Fusing Process)

As the fusing method in said fusing process, a salting-out/fusing method is preferably employed in which fine resin particles (fine colored or non-colored resin particles), obtained employing said polymerization method.

Further, in said fusing process, it is possible to fuse fine particles of internal additives such as releasing agents, charge control agents, and the like, along with fine resin particles and fine colorant particles.

The "water based medium" as described in said fusing process means one in which the main component (at least 50 percent by weight) is water. Herein, listed as components other than water may be organic solvents which are soluble in water. Examples include methanol, ethanol, isopropanol, butanol, acetone, methyl ethyl ketone, tetrahydrofuran and the like. Of these, alcohol based organic solvents, which do not dissolve resins, are specifically preferred.

Fine colorant particles may be prepared by dispersing colorants into a water-based medium. The dispersion process of said colorants is carried out in such a state that the concentration of surface active agents in water is at least at the critical micelle concentration (CMC).

Homogenizers, which are employed for said dispersion process of colorants, are not particularly limited. However, preferably cited are ultrasonic homogenizers, mechanical homogenizers, pressurized homogenizers such as Manton-Gaulin and pressure type homogenizers, medium type homogenizers such as sand grinders, a Getmann mill, a diamond fine mill, and the like. Further, listed as employed surface active agents may be those which are the same as described above.

Further, colorants (fine particles) may be subjected to surface modification. Said surface modification of colorants is carried out as follows. Colorants are dispersed into a solvent and surface modifiers are added into the resultant dispersion. Subsequently, the resultant mixture is subjected to reaction by increasing its temperature. After the completion of reaction, the obtained colorants are separated by filtration. Said filtered colorants are subjected to repeated washing and filtration employing the same solvent, and subsequently dried. Thus colorants (pigments) modified with the surface modifiers are obtained.

The preferred salting-out/fusing method comprises a process in which a salting-out agent, comprised of alkali metal salts, alkali earth metal salts, and the like, is added as a flocculant into water comprising fine resin particles as well as fine colorant particles in an amount of exceeding the critical flocculation concentration and subsequently, by heating at a temperature above the glass transition point of said fine resin particles, salting-out and fusion are simultaneously carried out. In this process, employed may be a method in which an organic solvent, which is infinitely soluble in water, is added to substantially lower the glass transition temperature of said fine resin particle so that fusion is effectively carried out.

Herein, in alkali metal salts and alkali earth metal salts employed as salting-out agents, listed as alkali metals are lithium, potassium, sodium, and the like, and as alkali earth metal are magnesium, calcium, strontium, barium, and the like. Cited as preferred metals are potassium, sodium, magnesium, calcium, and barium. Cited as formed salts are chlorides, bromides, iodides, carbonates, sulfates, and the like.

Further, listed as said organic solvents, which are infinitely soluble in water, are methanol, ethanol, 1-propanol, 2-propanol, ethylene glycol, glycerin, acetone, and the like. Of these, preferred are alcohols such as methanol, ethanol, 1-propanol, and 2-propanol, which have at least three carbon atoms, and specifically 2-propanol is preferred.

When the salting-out/fusion of the present invention is carried out, it is preferable that the resting time after the addition of a salting-out agent is as short as possible. This reason for the benefit of a short rest period is not yet totally understood. However, depending on the rest time after salting-out, problems occur in which the particle diameter distribution fluctuates due to variation of the flocculation state of the particles, and also do the surface properties of fused toner fluctuate. Further, it is necessary that the temperature, at which the salting-out agent is added, is no higher than the glass transition temperature of fine resin particles. The reason for this is understood to be as follows. When a slating-out agent is added at a temperature higher than the glass transition temperature of the fine resin particles, the salting-out/fusion of said resin particles proceeds rapidly. However, it is extremely difficult to control the particle diameter, and problems occur in which large diameter grains are generated. This addition temperature range is to be no higher than the glass transition temperature of said resin, and is generally between 5 and 55° C., and preferably between 10 and 45° C.

Further, in the present invention, it is preferable to employ a method in which a salting-out agent is added at no higher than the glass transition temperature of fine resin particles, and thereafter, the resultant mixture is heated as soon as possible so that it is heated to at least the glass transition temperature of the same or higher. The time until to said temperature is preferably less than one hour. In addition, it is necessary to rapidly raise said temperature. The rate of temperature rise is preferably 0.25° C./minute. The upper limit is not specifically stated. However, when the temperature is abruptly raised, salting-out proceeds too quickly and problems occur in which it is difficult to control the particle diameter. Thus, said rate is preferably 5° C./minute or less.

(Filtration-Washing Process)

In this filtration-washing process, a filtration process is carried out in which said toner particles are separated from the toner particle dispersion obtained in the aforementioned process through filtration, and a washing process is carried out in which adhered materials such as surface active agents, salting-out agents, and the like, are removed from collected toner particles (cake-like aggregates) by filtration.

Herein, employed as filtration methods are a centrifugal separation method, a reduced pressure filtration method employing Nutsche and the like, as well as a filtration method employing a filter press and the like.

(Drying Process)

This process is employed to dry toner particles which have been subjected to said washing treatment.

Listed as dryers employed in this process can be a spray dryer, a vacuum-freeze dryer, a reduced pressure dryer, and the like. It is preferred to employ a stationary tray dryer, a movable tray dryer, a fluidized-bed dryer, a rotating type dryer, a stirring type dryer, and the like.

The moisture content of toner particles, which have been subjected to drying process, is preferably not more than 5 percent by weight, and is more preferably not more than 2 percent by weight.

Further, when toner particles, which have been subjected to drying process, aggregate with each other due to weak attractive force between particles, said aggregates may be subjected to crushing. Herein, employed as crushing devices can be mechanical crushing ones such as a jet mill, a Henschel mixer, a coffee mill, food processors, and the like.

(External Additive Addition Process)

This process is one in which external additives are added to toner particles which have been subjected to the drying treatment.

Listed as devices employed to add said additives may be various mixers such as a turbular mixer, a Henschel mixer, a Nauter mixer, a V-shaped mixer, and the like, which are known in the art.

In addition to colorants and releasing agents, other materials, which provide various functions, may be incorporated into said toner. Specifically, listed are charge control agents. It is possible to add these components by employing various methods such as those in which during the stage of polymerizing of fine resin particles, a dispersion comprising these components is added, a method in which during the aforementioned salting-out/fusing stage, these components are simultaneously added along with fine resin particles and colorant particles so as to be incorporated into the toner, a method in which these components are added to the fine resin particles themselves, and the like. Cited as preferred methods are those in which during said stage of polymerizing fine resin particles, charge control agent particles and/or releasing agent particles are added in the form of a dispersion, and in which during said salting-out/fusing process, charge control agent particles and/or releasing agent particles are simultaneously added along with fine resin particles and colorant particles in the form of separate suspensions and the resulting mixture is subjected to salting-out/fusion.

Further, preferably employed as releasing agents are those which are known in the art and are capable of being dispersed in water. Specifically, it is possible to list olefin based waxes such as polypropylene, polyethylene, and modified products thereof, natural waxes such as carnauba wax, rice wax, and the like, amide based waxes such as fatty acid bisamide, and the like. These are added as the releasing agent particles and can be subjected to salting-out/fusion along with resins as well as colorants.

In the same manner, it is possible to use various charge control agents which are known in the art and are capable of being dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof, and the like.

Particles of these releasing agents and charge control agents preferably have a number average particle diameter of 10 to 500 nm in the dispersed state.

<Particle Diameter of Toners>

Herein, the volume average particle diameter of the toner is preferably between 3 and 9 $\mu$m, and is more preferably between 4 and 8 $\mu$m.

The volume average particle diameter as described herein is a value measured employing a Coulter Counter TA-11, Coulter Multisizer, SLAD1100 (a laser diffraction type particle diameter meter, manufactured by Shimadzu Seisakusho). Employing the Coulter Counter TA-11 and Coulter Multisizer, the values are shown employing a particle distribution in the range of 2.0 to 40 $\mu$m with the use of an aperture diameter of 100 $\mu$m.

<Developers>

The toner of the present invention may be employed as either a single component developer or a two-component developer. However, it is preferably employed as a two-component developer.

When employed as a single component developer, there is a method in which said toner is employed as a non-magnetic single component developer without any further alteration. Generally, however, magnetic particles having a size of about 0.1 to about 5 $\mu$m are incorporated into toner particles and employed as a magnetic single component developer. As the incorporation method, magnetic particles are incorporated into non-spherical particles in the same manner as for colorants.

Further, the toner is blended with a carrier, and can be employed as a two-component developer. In such case, employed as magnetic particles of the carrier are conventional materials, known in the art, such as iron, ferrite, magnetite, and the like, as well as alloys of such metal with other metals such as aluminum, lead, and the like. Of these, ferrite is specifically preferred. Said magnetic particles preferably have a volume average diameter of 15 to 100 $\mu$m, and more preferably have one between 25 to 60 $\mu$m.

The volume average particle diameter of said carrier is typically measured employing a laser diffraction type particle distribution meter, "HELOS", (manufactured by Sympatec Co.) provided with a wet type homogenizer.

The carrier is preferably one which is obtained by further coating resin onto magnetic particles, or a so-called resin-dispersed type carrier which is obtained by dispersing magnetic particles into resin. Resin compositions for coating are not particularly limited. For example, employed are olefin based resins, styrene based resins, styrene/acryl based resins, silicone based resins, ester based resins, fluorine containing polymer based resins, and the like. Further, resins to compose the resin-dispersed type carrier are also not particularly limited, and any of those known in the art may be employed. For example, employed may be styrene acrylic resins, polyester resins, fluorine based resins, phenol resins, and the like.

<Fixing Unit>

The toner of the present invention is employed in an image forming method (being the image forming method of the present invention) comprising a fixing process utilizing a specific fixing unit.

FIG. 1 is a cross-sectional view showing one example of the fixing unit employed in the present invention. The fixing unit shown in FIG. 1 is comprised of heating roller 10 and pressure roller 20, being in contact with said heating roller 10. In FIG. 1, T is a toner image formed on a paper transfer sheet.

Heating roller 10 is comprised of core metal 11 having thereon cover layer 12 comprised of a fluorine based resin, and includes heating member 13 comprised of a linear heater.

Said metal core 11 is comprised of metal selected from aluminum, iron, and copper, or alloys thereof. Its inner diameter is between 10 and 50 mm.

The wall thickness of said metal core 11 is to be between 0.1 and 2 mm, and is determined to achieve a balance between the demand for energy saving (a decrease in thickness) and the strength (dependent on composition of the structured materials). For example, when a 0.57 mm thick metal core comprised of iron is replaced with one comprised of aluminum, in order to retain the same strength, it is necessary to increase the wall thickness to 0.8 mm.

Exemplified as fluorine based resins composing cover layer 12 are PTFE (polytetrafluoroethylene), PFA (tertafluoroethylene-perfluoroalkyl vinyl ether copolymers), and the like.

The thickness of cover layer 12 is between 50 and 1,000 $\mu$m.

Suitably employed as heating member 13 is a halogen heater.

Figure 2:
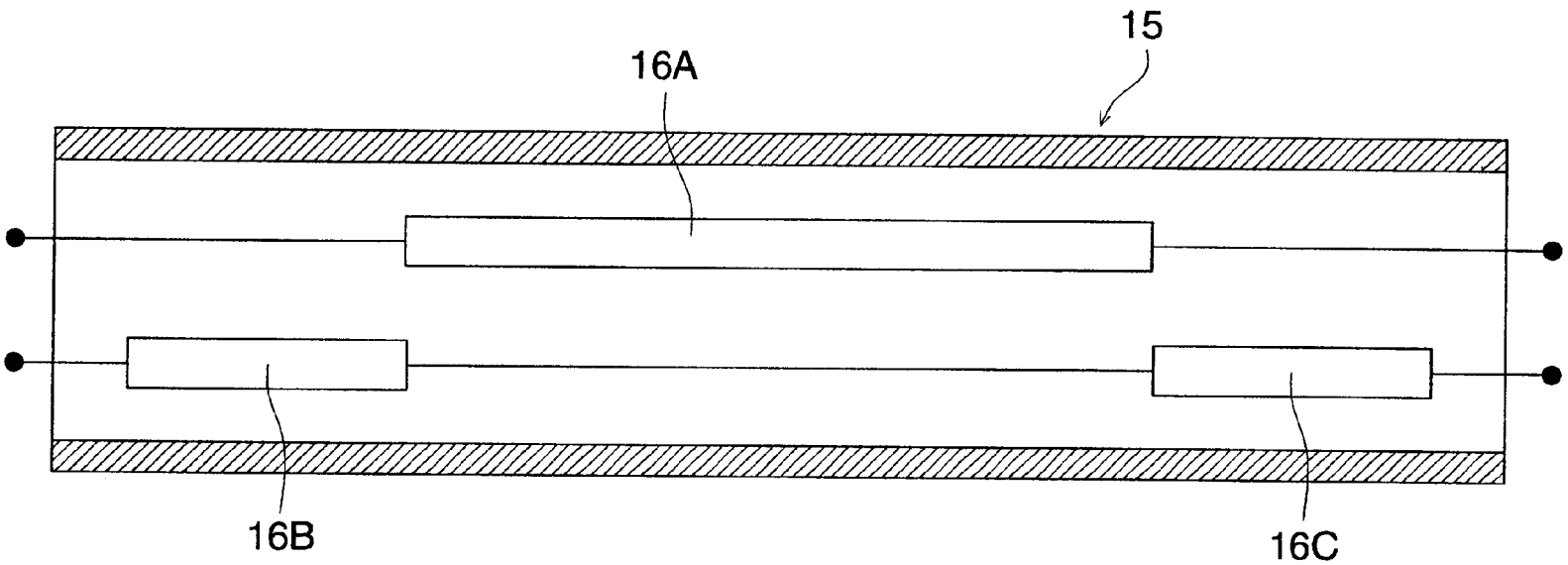
FIG. 2 is a cross-sectional view showing an example of a heating roll.

Further, instead of employing one heating member, as shown in FIG. 2, a plurality of heating members may be arranged in the interior so that heat furnishing regions can be varied in response to the passing paper size (width). In heating roller 15, illustrated in FIG. 2, there are arranged, halogen heater 16A which heats the central region of the roller surface, and halogen heaters 16B and 16C which heat the edges of the roller surface.

By employing said heating roller 15, as shown in FIG. 2, when narrow paper is passed through, halogen heater 16A may only be energized, while when wide paper is passed through, halogen heaters 16B as well as 16C may also be energized.

Pressure roller 20 comprises core metal 21 having thereon cover layer 22 comprised of silicone rubber.

Said metal core 21 is comprised of metal such as aluminum, iron, and the like, or alloys thereof.

The thickness of cover layer 22 is between 1 and 30 mm.

The Asker C Hardness of the silicone rubber composing cover layer 22 is preferably between 35 and 75, and is preferably between 40 and 50. Silicone foam rubber may also be employed.

The contact load (total load) between heating roller 10 and pressure roller 20 is commonly between 4 and 35 kgf, and is preferably between 5 and 25 kgf. Said contact load is specified taking into account the strength (the wall thickness of the core metal) of heating roller 10. For example, when a heating roller comprising a 0.3 mm thick metal core, such as iron, is employed, the contact load is preferably adjusted to not more than 25 kgf.

From the viewpoint of offset resistance as well as fixability, nip width is preferably between 4 and 8 mm, and the surface pressure of said nip is preferably between 0.6 and 1.5 kgf/cm$^2$.

When a fixing unit, as illustrated in FIG. 1, is employed, the following conditions may be employed as one example: fixing temperature (the surface temperature of heating roller 10) is between 150 and 210° C., and the linear rate of fixing is between 80 and 640 mm/second.

If desired, in the fixing unit employed in the present invention, a cleaning mechanism may be provided with the fixing section. In such case, a cleaning method may be employed in which as a system to furnish silicone oil onto the roller of the fixing section, a pad, roller, web, and the like, which is impregnated with silicone oil, are employed.

Employed as silicone oil are those having high heat resistance such as polydimethylsilicone, polyphenylmethylsilicne, polyphenylsilicone, and the like. When the silicone oil has a low viscosity, the amount of its flowout increase. Therefore, those, having a viscosity in the range of 1,000 to 100,000 cp, are suitably employed.

Specifically, the present invention exhibits marked effects for a system in which a definite amount of silicone oil is used. The reasons for the effects are assumed to be as follows. Since said silicone oil is electrically insulative, a heating roller having silicone oil on its surface is subjected to an increase in accumulation of charge due to triboelectrical charge formed by the friction with rotating pressure roller. As a result, repellency tends to occur. However, the resulting repellency is effectively minimized according to the present invention. The coating amount of silicone oil is preferably between 0.1 and 10 $\mu$g/cm$^2$.

Further, in said fixing unit, in order to minimize excessive heating at the edges of the roller surface, a cooling fan, and the like, may be installed near said edges.

EXAMPLES

The present invention will now be detailed with reference to examples. Incidentally, in the following, "parts" means "parts by weight" unless otherwise specified.

(Colored Particle Production Example 1)

(1) Preparation of Colored Particle Dispersion

While stirring, placed into 10.0 liters of pure water was 0.90 kg of sodium n-dodecyl phosphate, which was subsequently dissolved. While continuing to stir, gradually added to the resulting solution were 1.20 kg of Regal 330 R (a carbon black, manufactured by Cabot Co.), and the resulting mixture was continually dispersed for 20 hours employing a sand grinder (a medium type homogenizer). After dispersion, the particle diameter of the resulting dispersion was measured employing an electrophoretic light scattering photometer, ELS-800, manufactured by Otsuka Denshi Co. The obtained particle diameter was 122 nm in terms of the weight average diameter. Further, the solid portion concentration of said dispersion was measured employing a stationary drying weight method, thereby 16.6 percent by weight was obtained. The dispersion thus prepared was designated as "Colorant Dispersion 1".

(2) Preparation of Latex A1

Added to a mixture consisting of 567 g of styrene, 98 g of n-butyl acrylate, 35 g of methacrylic acid, and 24.1 g of t-dodecylmercaptan was a crystalline material (Crystalline material 1) shown in Table 2 below, according to the formula shown in Table 1 below. The resulting mixture was heated to 85° C. while stirring, and said crystalline material was then dissolved. Thus a monomer solution (a radical polymerizable monomer solution in which the crystalline material was dissolved) was prepared.

Subsequently, a four-necked flask equipped with a thermometer, a cooling pipe, and a stirrer, in which an aqueous solution, prepared by dissolving 1 g of sodium dodecybenzene sulfonate in 2,700 ml of pure water, was heated to 85° C., and at said temperature, the aforementioned monomer solution was added dropwise. Thus the resulting mixture was completely dispersed into the aqueous solution containing the surface active agent while applying ultrasonic vibration at 85° C.

Thereafter, the resulting dispersion was cooled to 70° C., and a water-soluble polymerization initiator solution, prepared by dissolving 8.3 g of ammonium persulfate in 500 ml of pure water, was added dropwise. The resulting mixture underwent reaction under a flow of nitrogen at 70° C. for 4 hours. Thereafter, the resulting mixture was cooled and foreign matter was removed employing a pole filter. Thus Latex A1 was obtained.

(3) Preparation of Latex B1

Added to a mixture consisting of 497 g of styrene, 168 g of n-butyl acrylate, 35 g of methacrylic acid, and 0.66 g of t-dodecylmercaptan, was a crystalline material (Crystalline material 1) shown in Table 2 below according to the formula shown in Table 1 below. While stirring, the resulting mixture was heated to 85° C., and said crystalline material was then dissolved. Thus a monomer solution (a radical polymerizable monomer solution in which the crystalline material was dissolved) was prepared.

Subsequently, a four-necked flask equipped with a thermometer, a cooling pipe, and a stirrer, in which an aqueous solution prepared by dissolving 1.34 g of sodium dodecybenzene sulfonate in 2,700 ml of pure water, was heated to 85° C., and at said temperature, the aforementioned monomer solution was added dropwise. Thus at 85° C., the resulting mixture was completely dispersed into the aqueous solution containing the surface active agent while applying ultrasonic vibration.

Thereafter, the resulting dispersion was cooled to 70° C., and a water-soluble polymerization initiator solution, prepared by dissolving 1.48 g of ammonium persulfate in 500 ml of pure water, was added dropwise. The resulting mixture was allowed to react, under a flow of nitrogen at 70° C. for 4 hours. Thereafter, the resulting mixture was cooled and foreign matter was removed employing a pole filter. Thus Latex B1 was obtained.

(4) Salting-out/Fusing Process

Added to 5.0 liters of deionized water were 1.07 kg of sodium chloride as the salting-out agent, and subsequently was dissolved while stirring. The resulting solution was designated as Sodium Chloride Solution A.

Placed in a reaction vessel, equipped with a thermal sensor, a cooling pipe, a nitrogen gas feeding unit, a stirrer, and a comb-shaped baffle, were 5.0 kg of Latex Al prepared as above, 5.0 kg of Latex B1, 0.4 kg of Colorant Dispersion 1, and 20.0 kg of deionized water, and the resulting mixture was stirred. The mixture was heated to 35° C. and Sodium Chloride Solution A was added. Thereafter, the resulting mixture was set aside for 5 minutes. Then the mixture was heated to 85° C. over 5 minutes (the rate of temperature increase was 10° C./minute). The mixture was stirred at 85±2° C. for 6 hours and underwent salting-out/fusion. Thereafter, the resulting mixture was cooled below 30° C. and stirring was terminated. The mixture was filtered employing a sieve having an opening of 45 μm. The resulting filtrate was designated as Coalesced Composition (1). Subsequently, wet, caked colored particles were collected from Coalesced Composition (1), employing a centrifuge. Thereafter, the resulting colored particles were washed with deionized water.

The wet, caked colored particles, which were subjected to washing as described above, were dried in 40° C. air. Thus colored particles were obtained. The resulting colored particles were designated as "Colored Particles 1". Said colored particles had a volume average particle diameter of 6.3 μm, and the molecular weight of the resin was 6,100 in terms of the number average molecular weight and was 53,000 in terms of the weight average molecular weight.

(Production Examples 2 through 15 of Colored Particles)

Colored Particles 2 through 15 were obtained in the same manner as Production Example 1 of Colored Particles, except that when Latex A1, as well as Latex B1, was prepared, each of the crystalline materials shown in Table 2 below, was employed according to each of the formulas shown in Table 1 below.

TABLE 1

| Colored Particles | | Crystalline Substance | Added Amount |
|---|---|---|---|
| Colored | for Latex A1 | Crystalline Substance 1 | 100 g |
| Particles 1 | for Latex B1 | Crystalline Substance 1 | 100 g |
| Colored | for Latex A1 | Crystalline Substance 2 | 100 g |
| Particles 2 | for Latex B1 | Crystalline Substance 2 | 100 g |
| Colored | for Latex A1 | Crystalline Substance 3 | 100 g |
| Particles 3 | for Latex B1 | Crystalline Substance 3 | 100 g |
| Colored | for Latex A1 | Crystalline Substance 4 | 100 g |
| Particles 4 | for Latex B1 | Crystalline Substance 4 | 100 g |
| Colored | for Latex A1 | Crystalline Substance 5 | 100 g |
| Particles 5 | for Latex B1 | Crystalline Substance 5 | 100 g |
| Colored | for Latex A1 | Crystalline Substance 6 | 100 g |
| Particles 6 | for Latex B1 | Crystalline Substance 6 | 100 g |
| Colored | for Latex A1 | Crystalline Substance 7 | 100 g |
| Particles 7 | for Latex B1 | Crystalline Substance 7 | 100 g |
| Colored | for Latex A1 | Crystalline Substance 8 | 100 g |
| Particles 8 | for Latex B1 | Crystalline Substance 8 | 100 g |
| Colored | for Latex A1 | Crystalline Substance 9 | 100 g |
| Particles 9 | for Latex B1 | Crystalline Substance 9 | 100 g |
| Colored | for Latex A1 | Crystalline Substance 3 | 50 g |
| Particles 10 | for Latex B1 | Crystalline Substance 3 | 50 g |
| Colored | for Latex A1 | Crystalline Substance 2 | 150 g |
| Particles 11 | for Latex B1 | Crystalline Substance 2 | 150 g |
| Colored | for Latex A1 | Crystalline Substance 3 | 200 g |
| Particles 12 | for Latex B1 | Crystalline Substance 3 | 200 g |
| Colored | for Latex A1 | none | — |
| Particles 13 | for Latex B1 | Crystalline Substance 3 | 100 g |
| Colored | for Latex A1 | Crystalline Substance 3 | 100 g |
| Particles 14 | for Latex B1 | none | — |
| Colored | for Latex A1 | none | — |
| Particles 15 | for Latex B1 | none | — |

TABLE 2

| Crystalline Substance | Composition | Melting Point (in ° C.) | Number Average Molecular Weight (Mn) | Viscosity at Molten State (at the melting point + 20° C.) (in dPa · s) |
|---|---|---|---|---|
| Crystalline Substance 1 | EG + succinic acid | 103 | 8,600 | 34.0 |
| Crystalline Substance 2 | CHD + adipic acid | 97 | 5,200 | 4.0 |
| Crystalline Substance 3 | CHD + adipic acid | 105 | 8,500 | 54.0 |
| Crystalline Substance 4 | CHD + adipic acid | 123 | 9,500 | 74.0 |
| Crystalline Substance 5 | CHD + adipic acid | 136 | 13,500 | 106.0 |
| Crystalline Substance 6 | 1,4 BD/EG + succinic acid | 85 | 3,500 | 1.4 |
| Crystalline | EG + sebacic | 72 | 4,500 | 6.2 |

TABLE 2-continued

| Crystalline Substance | Composition | Melting Point (in ° C.) | Number Average Molecular Weight (Mn) | Viscosity at Molten State (at the melting point + 20° C.) (in dPa · s) |
|---|---|---|---|---|
| Substance 7 | acid | | | |
| Crystalline Substance 8 | 1,6 HD + sebacic acid | 65 | 3,500 | 14.2 |
| Crystalline Substance 9 | 1,6 HD + sebacic acid | 55 | 2,500 | 6.1 |

*CHD: 1,4-cyclohexanediol
*EG: ethylene glycol
*1,4 BD: 1,4-butanediol
*1,6 HD: 1,6-hexanediol Added to each of said Colored Particles 1 through 15 was hydrophobic silica (having a hydrophobicity of 65 and a number average primary Particles diameter of 12 nm) in an amount of 1.0 percent by weight, and thus the toner examples were obtained. Resulting toners were designated as "Toners 1 through 15".

Developer, having a toner concentration of 6 percent, was prepared by blending each of Toners 1 through 15 with silicone resin-coated ferrite carrier granules having a volume average Particles diameter of 60 μm. Resulting mixtures were designated as "Developers 1 through 15", corresponding to each of the cited toners.

Examples 1 Through 14 and Comparative Example 1

(Actual Image Forming Tests)

Employing each of Developer 1 through 15, offset resistance (the fixing offset forming temperature) as well as fiaxability (the fixing ratio of halftone) was evaluated by actual image formation using a digital copier Konica 7060 manufactured by Konica Corp. Table 3 shows the results. Incidentally, the development conditions were as follows:

(Development Conditions)

Photoreceptor: laminated type organic photoreceptor
DC bias: −500 V
Dsd (distance between the photoreceptor and the development sleeve): 600 μm
Developer Layer Regulation: magnetic H-Cut system
Developer thickness: 700 μm
Development Sleeve Diameter: 40 mm As the fixing unit, a pressure contact type thermal fixing unit was employed. The composition of the fixing unit and fixing conditions were as follows:

(Fixing Unit)

The fixing unit comprises an upper roller comprised of a cylindrical iron with a diameter of 30 mm, covered on its surface with a tetrafluoroethyllen-perfluoroalkyl vinyl ether copolymer (PFA), which has a centered heater in its interior, and a lower roller with a diameter of 30 mm comprised of silicone rubber, its surface covered on with a tetrafluoroethyllen-perfluoroalkyl vinyl ether copolymer. The linear pressure was set at 0.8 kg/cm and the nip width was set at 4.3 mm.

(Fixing Conditions)

Employing said fixing unit, the printing line speed was set at 250 mm/second. Further, employed as a cleaning mechanism of said fixing unit was a supply system of a web system impregnated with polydiphenylsilicone (having a viscosity of 10,000 cp at 20° C.). The fixing temperature was controlled employing the surface temperature of the upper roller and was set at 185° C. Further, the coated amount of silicone oil was set at 0.8 $\mu g/cm^2$.

(1) Fixing Offset Forming Temperature

The surface temperature (the value at the center) was varied in increments of 5° C. in the range of 150 to 210° C., and at each surface temperatures, an A4 size sheet, having a 5 mm wide solid black image perpendicular to the transport direction, was longitudinally conveyed and fixed. Thereafter, an A4 size sheet, having a 5 mm wide solid black image and a 20 mm wide halftone image, was laterally conveyed, and the temperature, at which image stain was formed due to fixing offset, was measured. Table 3 below shows the results.

(2) Halftone Fixing Ratio

The surface temperature (the value at the center) of the heating roller was maintained at 170° C. and the fixing ratio of said halftone image was measured. The fixing ratio was obtained as follows. A fixed image was rubbed with a one kg weight wrapped with bleached cotton cloth, and the image density, before and after rubbing, was measured, and the fixing ratio was calculated based on the formula described below. Table 3 below shows the results.

Fixing ratio=[(image density after rubbing)/(image density prior to rubbing)]×100

TABLE 3

| | Developer | Fixing Offset Forming Temperature | Halftone Fixing Ratio (in %) |
|---|---|---|---|
| Example 1 | Developer 1 | no formation | 93 |
| Example 2 | Developer 2 | no formation | 98 |
| Example 3 | Developer 3 | no formation | 91 |
| Example 4 | Developer 4 | no formation | 85 |
| Example 5 | Developer 5 | no formation | 73 |
| Example 6 | Developer 6 | no formation | 97 |
| Example 7 | Developer 7 | no formation | 94 |
| Example 8 | Developer 8 | 200° C. | 90 |
| Example 9 | Developer 9 | 195° C. | 92 |
| Example 10 | Developer 10 | no formation | 89 |
| Example 11 | Developer 11 | no formation | 98 |
| Example 12 | Developer 12 | no formation | 95 |
| Example 13 | Developer 13 | no formation | 89 |
| Example 14 | Developer 14 | no formation | 91 |
| Comparative Example 1 | Developer 15 | formed between 150 and 160° C. | 54 |

The toner in accordance with the present invention exhibits excellent offset resistance, a wide fixable temperature range, and further excellent fixability.

What is claimed is:

1. A toner comprising a resin binder and a colorant wherein the resin binder is obtained by fusing fine resin particles comprising a crystalline material and amorphous polymer in a water-based medium.

2. The toner of claim 1 wherein the crystalline material has a melting point of 60 to 130° C., a number average molecular weight of 1,500 to 15,000, and a melt viscosity at the melting point +20° C. of not more than 100 dpa·s.

3. The toner of claim 1 wherein the crystalline material is polyester, polyamide or polyimide.

4. The toner of claim 1 wherein the crystalline material is polyester which is a reaction product of aliphatic diol with an aliphatic dicarboxylic acid or a polyamide which is a reaction product of aliphatic diamine and aliphatic dicarboxylic acid.

5. The toner of claim 1 wherein the amorphous polymer has glass transition temperature (Tg) of 10–75° C.

6. The toner of claim 1 wherein the amorphous polymer has softening point of 80–220° C.

7. The toner of claim 1 wherein the amorphous polymer has weight average molecular weight (Mw) of 5,000–1,000,000.

8. The toner of claim 1 wherein the amorphous polymer has molecular weight distribution (Mw/Mn) is 2.0–100.

9. The toner of claim 1 wherein the amorphous polymer is composed of radically polymerizable monomer containing an acidic group or a basic group, and further, wherein content of the radically polymerizable monomer having acidic group or the radically polymerizable monomer having basic group is 0.1–15 weight % with respect to whole monomers.

10. The toner of claim 9 wherein the radically polymerizable monomer is a monomer containing a carboxyl group, a sulfonic acid group or an amino group.

11. The toner of claim 1 wherein amount of the crystalline material is 1–200 weight parts with reference to 100 weight parts of the amorphous polymer.

12. The toner of claim 1 wherein the amorphous polymer has glass transition temperature (Tg) of 10–75° C., softening point of 80–220° C., weight average molecular weight (Mw) of 5,000–1,000,000 and molecular weight distribution (Mw/Mn) is 2.0–100.

13. The toner of claim 2 wherein the amorphous polymer has glass transition temperature (Tg) of 40–65° C., softening point of 80–220° C., weight average molecular weight (Mw) of 8,000–500,000 and molecular weight distribution (Mw/Mn) is 5.0–80.

14. The toner of claim 3, wherein the amorphous polymer has glass transition temperature (Tg) of 10–75° C., softening point of 80–220° C., weight average molecular weight (Mw) of 5,000–1,000,000 and molecular weight distribution (Mw/Mn) is 2.0–100, and the amorphous polymer is composed of radically polymerizable monomer containing an acidic group or a basic group.

15. The toner of claim 14 wherein the crystalline material is an aliphatic polyester or aliphatic polyamide having a melting point of 60 to 120° C., a number average molecular weight of 2,000 to 10,000.

16. The toner of claim 14 wherein content of the radically polymerizable monomer having acidic group or the radically polymerizable monomer having basic group is 0.1–15 weight % with respect to whole monomers.

17. The toner of claim 1 wherein the crystalline material has an endothermic peak (P1) in the range of 50 to 130° C. during the first temperature rising stage and an exothermic peak (P2) in the range of 30 to 110° C. during the first cooling process, as measured with a DSC, and P1 is not lower than P2.

18. The toner of claim 1 wherein the crystalline material has an endothermic peak (P1) in the range of 60 to 120° C. during the first temperature rising stage and an exothermic peak (P2) in the range of 40 to 100° C. during the first cooling process, as measured with a DSC, and P1 is not lower than P2.

19. A developer comprising a toner of claim 1.

20. A method of preparation of toner by fusing fine resin particles comprising a crystalline material and amorphous polymer in a water-based medium.

* * * * *